US009249367B2

(12) United States Patent
Yows

(10) Patent No.: US 9,249,367 B2
(45) Date of Patent: Feb. 2, 2016

(54) INJECTOR HAVING INTERCHANGEABLE INJECTOR ORIFICES

(75) Inventor: Stephen Arthur Yows, Canoga Park, CA (US)

(73) Assignee: Gas Technology Institute, Des Plaines, IL (US)

( * ) Notice: Subject to any disclaimer, the term of this patent is extended or adjusted under 35 U.S.C. 154(b) by 756 days.

(21) Appl. No.: 13/543,311

(22) Filed: Jul. 6, 2012

(65) Prior Publication Data

US 2014/0008466 A1 Jan. 9, 2014

(51) Int. Cl.

| | |
|---|---|
| ***B05B 1/26*** | (2006.01) |
| ***C10J 3/72*** | (2006.01) |
| ***B05B 7/06*** | (2006.01) |
| ***B05B 7/04*** | (2006.01) |
| ***B05B 15/06*** | (2006.01) |
| ***B05B 1/02*** | (2006.01) |
| ***B05B 1/16*** | (2006.01) |
| ***C10J 3/52*** | (2006.01) |

(52) U.S. Cl.

CPC . *C10J 3/723* (2013.01); *B05B 1/02* (2013.01); *B05B 1/16* (2013.01); *B05B 7/04* (2013.01); *B05B 7/06* (2013.01); *B05B 15/065* (2013.01); *C10J 3/526* (2013.01); *C10J 2200/152* (2013.01)

(58) Field of Classification Search

CPC ..... B05B 7/06; B05B 7/014; B05B 15/065; B05B 1/02; B05B 1/16; C10J 3/526; C10J 3/723; C10J 2200/152

USPC ..... 239/423, 424, 424.5, 429, 430, 433, 239/543, 544, 390, 391, 396, 591

See application file for complete search history.

(56) References Cited

U.S. PATENT DOCUMENTS 6,486,081 B1 * 11/2002 Ishikawa et al. ..... 438/788
7,303,141 B2 * 12/2007 Han et al. ..... 239/543

* cited by examiner

*Primary Examiner* — Steven J Ganey
(74) *Attorney, Agent, or Firm* — Pauley Erickson & Kottis

(57) ABSTRACT

An impingement injector includes an injector core having a plurality of conduits. The conduits include a first conduit and second conduits disposed circumferentially around the first conduit. The second conduits are at an impinging angle with respect to the first conduit. Replaceable, tunable jets are disposed in corresponding ones of the second conduits.

18 Claims, 3 Drawing Sheets

INJECTOR HAVING INTERCHANGEABLE INJECTOR ORIFICES

BACKGROUND

This disclosure relates to improvements in injectors for carbonaceous gasifier systems.

Carbonaceous gasifier systems are known and used to convert coal, petcoke or the like to synthesis gas (syngas), e.g., a mixture of hydrogen and carbon monoxide. A typical gasifier system includes a reactor vessel and an injector through which reactants, such as carbonaceous fuel and oxidant, are injected into the reactor vessel for combustion. The reactants are injected through injector orifices in the injector.

SUMMARY

An impingement injector according to an exemplary aspect of the present disclosure includes an injector core having a plurality of conduits. The conduits include a first conduit and second conduits disposed circumferentially around the first conduit. The second conduits are at an impinging angle with respect to the first conduit. Replaceable, tunable jets are disposed in corresponding ones of the second conduits.

In a further non-limiting embodiment, the plurality of replaceable, tunable jets are tubes.

In a further non-limiting embodiment of any of the foregoing examples, the tubes extend completely between the first side and the second side.

In a further non-limiting embodiment of any of the foregoing examples, at least a portion of the tubes threadingly engage the injector core.

In a further non-limiting embodiment of any of the foregoing examples, at least one of the tubes is made of a first material and the injector core is made of a second material different from the first material in composition.

In a further non-limiting embodiment of any of the foregoing examples, at least a portion of the tubes breach at least one of the first side or the second side.

In a further non-limiting embodiment of any of the foregoing examples, the tubes each include an open end lying in a plane that is inclined with regard to a central axis of the tube.

In a further non-limiting embodiment of any of the foregoing examples, the tubes include an internal surface having a faceted geometry.

In a further non-limiting embodiment of any of the foregoing examples, the faceted geometry is a faceted, hexagonal geometry.

In a further non-limiting embodiment of any of the foregoing examples, the injector core is a cylindrical plate.

A method of tuning a gasifier system according to an exemplary aspect of the present disclosure includes tuning an injector in situ in a gasifier reactor system by changing a geometry of injection orifices of the injector in response to a characteristic of the gasifier reactor system, to influence performance of the gasifier reactor system.

In a further non-limiting embodiment of any of the foregoing examples, the injection orifices extend through respective tubes carried in corresponding conduits in a core of the injector, and the tuning includes removing at least one of the tubes and inserting at least one different tube having at least one differently sized injection orifice extending there through.

In a further non-limiting embodiment of any of the foregoing examples, the characteristic includes velocity and momentum of reactants flowing through the injector.

A method of assembling an impingement injector according to an exemplary aspect of the present disclosure includes providing an injector core that extends between a first side and a second side, the injector core including a plurality of conduits extending from the first side to the second side, the plurality of conduits including a first conduit and second conduits disposed circumferentially around the first conduit, the second conduits being at an impinging angle with respect to the first conduit, and inserting tubes into corresponding ones of the second conduits.

A further non-limiting embodiment of any of the foregoing examples includes removing one of the tubes from one of the second conduits, the removed tube having an injector orifice extending there through defining a first diameter, and inserting a replacement tube into the one second conduit, the replacement tube having an injector orifice extending there through defining a different, second diameter.

In a further non-limiting embodiment of any of the foregoing examples, the removing, and the inserting of the replacement tube, are responsive to a characteristic of a gasifier reactor system, to influence performance of the gasifier reactor system.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
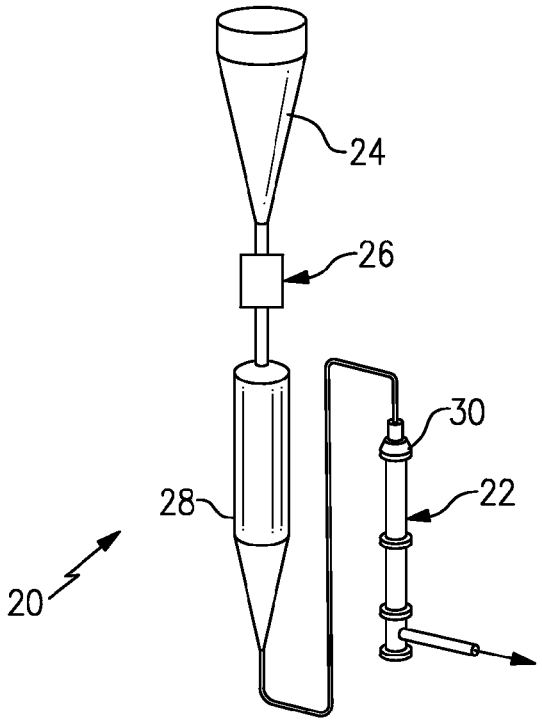
FIG. 1 shows an example gasifier system.

FIG. 1 illustrates selected portions of a carbonaceous gasifier system 20 configured for gasification of coal, petcoke or the like to produce syngas. The gasifier system 20 generally includes an entrained-flow gasifier 22, or reactor vessel, that is generally a hollow vessel. The gasifier 22 is connected with a low pressure hopper 24, a dry solids pump 26 and a high pressure tank 28 for providing carbonaceous material to the gasifier 22 in a known manner.

The gasifer 22 includes an injector 30 to receive and inject the carbonaceous material and an oxidant into the interior volume of the gasifier 22. As an example, the injector 30 is an impingement-style, jet injector. The carbonaceous material combusts within the gasifier 22 to produce the syngas, which may then be provided downstream to one or more filters for further processing, as is known.

Injectors are designed to provide high efficiency mixing of the carbonaceous material and the oxidant to achieve efficient combustion. The mixing depends upon the velocity and momentum at which the carbonaceous material and the oxidant are injected into a gasifier. However, the actual velocity and momentum in a given gasifier system and injector can vary from design velocity and momentum. For example, the velocity and momentum can vary depending upon the type of carbonaceous material. Moreover, there can be variations in velocity and momentum between the same type of carbonaceous material mined from different sources. For example, coal from different mines can vary in physical properties and cause differences in injection velocity and momentum. Thus, the actual mixing efficiency of an injector may be below the intended design efficiency, which reduces the actual efficiency of the gasifier system.

The injector 30 disclosed herein is tunable with regard to velocity and momentum of the reactants. This enables the injector 30 to be adjusted on site, or in situ in the gasifier 22, in response to given velocity and momentum data of the gasifier 22, to improve performance of the gasifier system 20.

Figure 2:
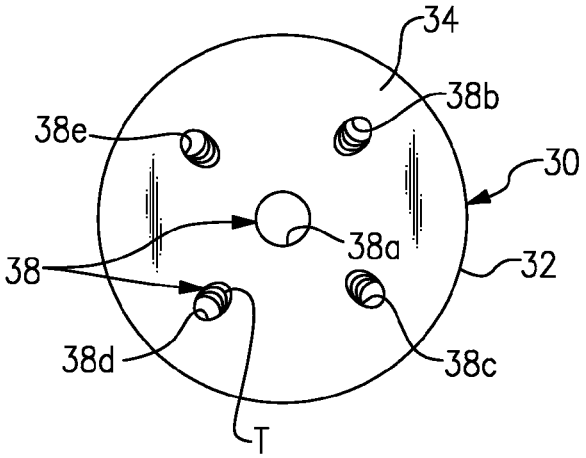
FIG. 2 shows an example injector of the gasifier system of FIG. 1.
Figure 3:
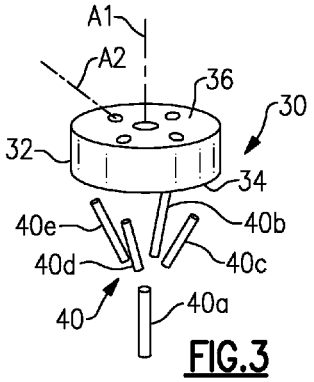
FIG. 3 shows an expanded view of the injector of FIG. 2.
Figure 4:
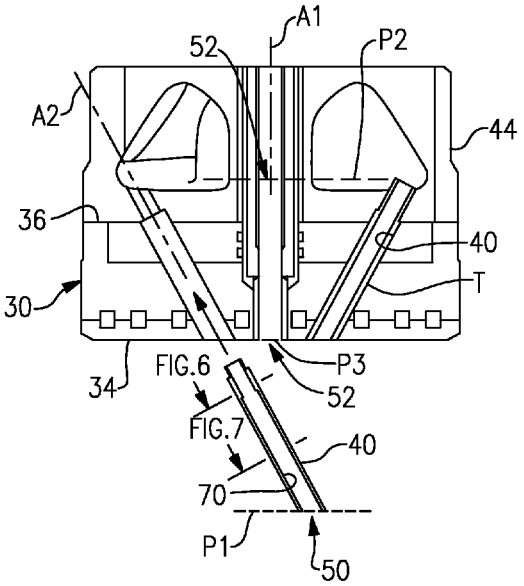
FIG. 4 shows a partially assembled view of the injector of FIG. 2.

FIG. 2 shows a bottom view of the injector 30, FIG. 3 shows an expanded view of the injector 30 and FIG. 4 shows a partially assembled view of the injector 30. Referring to FIGS. 2-4, the injector 30 includes an injector core 32 that extends between a first side 34 and a second side 36. The first side 34 faces into the gasifier 22 and is thus considered to be a hot side. In this example, the injector core 32 is a cylindrical plate.

The injector core 32 includes a plurality of conduits 38 that extend from the first side 34 to the second side 36. In this example, the conduits 38 include a first, central conduit 38*a* and four second conduits 38*b-e* that are circumferentially arranged around the first conduit 38*a*. It is to be understood that the injector core 32 can alternatively include fewer conduits 38 or additional conduits 38 than shown. The first conduit 38*a* extends along a respective central axis A1 that is substantially parallel to the first side 34 and the second side 36 in this example. The second conduits 38*b-e* extend along respective central axes A2 (one shown) that are inclined relative to the central axis A1. That is, the central axes, and thus the second conduits 38*b-e*, are at an impinging angle with respect to the first conduit 38*a*.

The injector 30 further includes a plurality of replaceable, tunable jet tubes 40. The tubes 40 are insertable into, and removable from, the conduits 38. In this example, the tubes 40 include a central tube 40*a* and four impingement tubes 40*b-e* that extend completely between the first side 34 and the second side 36. For example, the central tube 40*a* is used for carbonaceous material (fuel) injection the impingement tubes 40*b-e* are used for oxidant injection. Alternatively, the injector 30 can include a different number and/or arrangement of the tubes 40.

Figure 5:
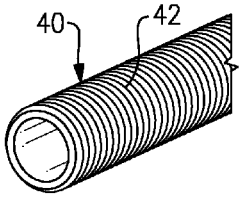
FIG. 5 shows a perspective view of threads on a nozzle tube for an injector.

One or all of the tubes 40 include an exterior threading 42, as shown in FIG. 5, for threadingly engaging corresponding threading T in the conduits 38 to secure the tubes 40 within the conduits 38. In one example, the impingement tubes 40*b-e* include the exterior threading 42, while the central tube 40*a* does not. In this example, the central tube 40*a* is retained by a mating cover piece 44 that is secured to the injector core 32. The central tube 40*a* breaches the second side 36 for connection with the cover piece 44. The impingement tubes 40*b-d* also breach the second side 36 but are retaining by the exterior threading 42 and threading T rather than by connection to the cover piece 44.

Each of the impingement tubes 40*b-e* have an open end 50 lying in a plane P1 that is inclined with regard to a central axis of the impingement tubes 40*b-e*, which is co-axial with the central axis A2 of the corresponding conduit 38. In this example, the open ends 50 are thus substantially flush with the first side 34 of the injector core 32. The central tube 40*a* has open ends 52 lying in respective planes P2 and P3 that are substantially perpendicular to the central axis A1.

Figure 6:
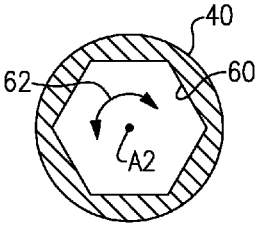
FIG. 6 shows a cross-section of a nozzle tube for an injector.

As shown in FIG. 6, one or more of the tubes 40 includes an internal surface 60 configured to facilitate insertion or removal of the tubes 40 from the conduits 38. Thus, the internal surface 60 has a geometry corresponding to a geometry of a tube installation tool. In this example, the internal surface 60 has a faceted, hexagonal geometry that corresponds to the shape of a hex key tool (not shown). The hex key tool can be inserted into the tube 40 to rotate the tube 40 about its central axis to insert or remove the tube 40, as indicated by arrow 62.

The internal surface 60 having the faceted geometry can extend over only a portion of the interior length of the tube 40. The remainder of the interior surface of the nozzle tube 40 can be relatively smooth and have a circular geometry, as shown in the cross-section in FIG. 7.

Figure 7:
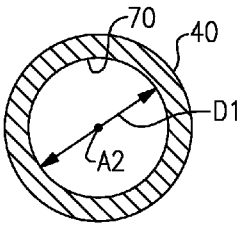
FIG. 7 shows another cross-section of a nozzle tube for an injector.
Figure 8:
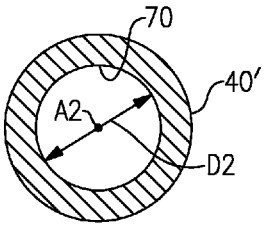
FIG. 8 shows a cross-section of a differently sized nozzle tube for an injector.

As shown in FIG. 7, each of the tubes 40 includes an injector orifice 70 defining a diameter D1. FIG. 8 shows a cross-section through a tube 40'. The tube 40' is identical to tube 40 but includes an injector orifice 70 defining a diameter D2 that is different than the diameter D1 (unequal). The diameter D2 can be larger or smaller than the diameter D1. The tubes 40 and 40' are interchangeable within any one of the conduits 38 and thus the outside diameters and geometries are identical. That is, the tubes 40/40' can be interchanged in the injector core 32 to adjust the injector 30 on site, or in situ, in response to given velocity and momentum data of the gasifier 22.

Figure 9:
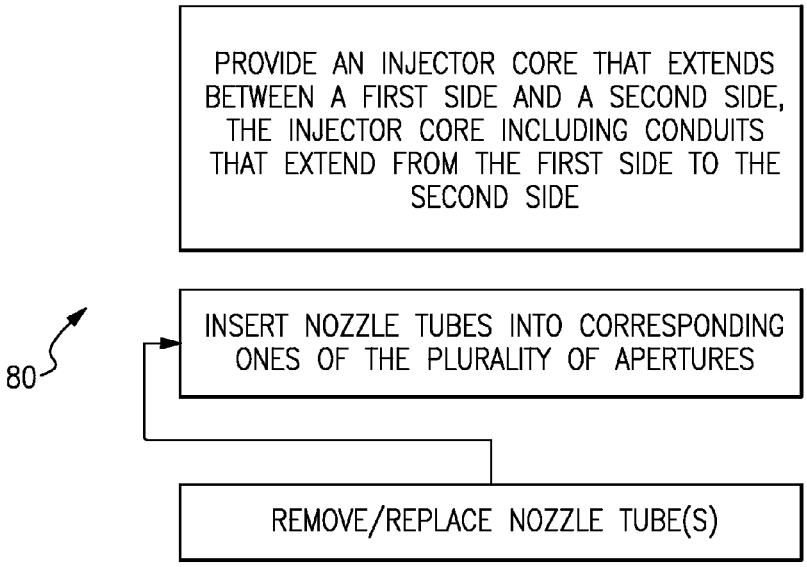
FIG. 9 shows an example method of assembling a nozzle tube for a gasifier system.

In this regard, FIG. 9 illustrates a method 80 of assembling the injector 30. The method 80 includes providing the injector core 32 as described herein, inserting the tubes 40 into corresponding ones of the conduits 38, and removing the tubes 40 and replacing one or more of the tubes 40 with one or more of the tubes 40'.

Figure 10:
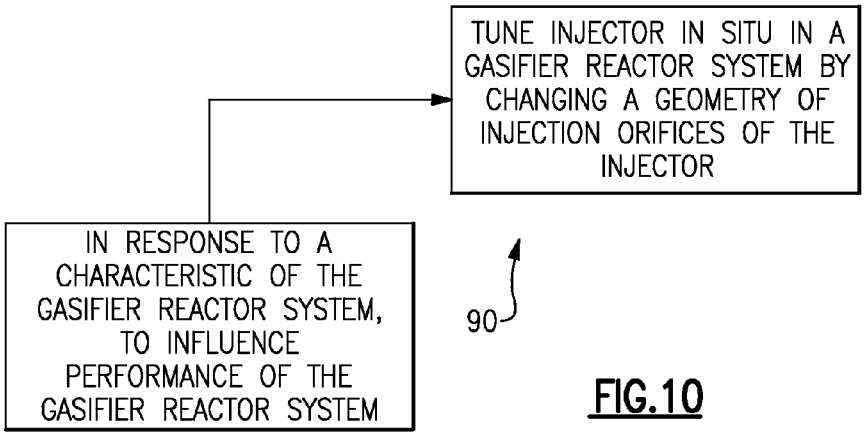
FIG. 10 shows an example method of tuning a gasifier system.

As shown in FIG. 10, the injector 30 also embodies a method 90 of tuning the gasifier system 20. If the tubes 40 having diameters D1 provide a mixing efficiency that is less than desired for given parameters of velocity and momentum of the reactants in the gasifier system 20, one or more of the tubes 40 can be removed and replaced with tubes 40' having the different diameter D2 to adjust, or tune, the mixing efficiency of the injector 30. Thus, there is no need to provide an entirely new injector and a user can simply switch in the tubes 40'.

Additionally, the common injector core 32 can be provided to a variety of different gasifier systems 20 that utilize different carbonaceous materials or the same carbonaceous materials from different sources by simply interchanging tubes 40/40'. As can be appreciated, additional tubes having other, different diameters can also be provided for greater flexibility in tuning the injector 30. Moreover, using the tubes 40/40' that are separate and removable from the injector core 32 permits one or more of the tubes 40/40' to be made of a different material from the injector core 32. For example, the tubes 40/40' are made of a first material and the injector core 32 is made of a second material that is different from the first material in composition. Thus, the first and second materials can be selected for enhanced performance of the function of the tubes 40/40' and injector core 32. For instance, a highly oxidation resistant material can be selected for the tubes 40/40' and a highly refractory material can be selected for the injector core 32. In a further example, the first and second materials are different superalloys.

The method 90 thus includes tuning the injector 30 in situ by changing a geometry of the injection orifices 70 of the injector 30. The tuning is in response to a characteristic of the gasifier system 20, to influence performance of the gasifier system 20. In one example, the characteristic includes the velocity and momentum data of the reactants flowing through the injector 30. As described above, the tuning includes removing at least one of the tubes 40 and inserting at least one different tube 40' having at least one differently sized injection orifice 70.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An impingement injector comprising:

an injector core that extends between a first side and a second side including a plurality of conduits, the plurality of conduits including a first conduit and second conduits disposed circumferentially around the first conduit, the second conduits being at an impinging angle with respect to the first conduit; and a plurality of replaceable, tunable jets disposed in corresponding ones of the second conduits, wherein the plurality of replaceable, tunable jets are tubes and wherein at least a portion of the tubes breach at least one of the first side or the second side.

2. The impingement injector as recited in claim 1, wherein the tubes extend completely between the first side and the second side.

3. The impingement injector as recited in claim 1, wherein at least a portion of the tubes threadingly engage the injector core.

4. The impingement injector as recited in claim 1, wherein at least one of the tubes is made of a first material and the injector core is made of a second material different from the first material in composition.

5. The impingement injector as recited in claim 1, wherein the tubes each include an open end lying in a plane that is inclined with regard to a central axis of the tube.

6. The impingement injector as recited in claim 1, wherein the tubes include an internal surface having a faceted geometry.

7. The impingement injector as recited in claim 6, wherein the faceted geometry is a faceted, hexagonal geometry.

8. The impingement injector as recited in claim 1, wherein the injector core is a cylindrical plate.

9. An impingement injector comprising:

an injector core that extends between a first side and a second side including a plurality of conduits, the plurality of conduits including a first conduit and second conduits disposed circumferentially around the first conduit, the second conduits being at an impinging angle with respect to the first conduit; and a plurality of replaceable, tunable jets disposed in corresponding ones of the second conduits, wherein the plurality of replaceable, tunable jets are tubes and wherein the tubes extend completely between the first side and the second side.

10. The impingement injector as recited in claim 9, wherein at least a portion of the tubes threadingly engage the injector core.

11. The impingement injector as recited in claim 9, wherein the tubes each include an open end lying in a plane that is inclined with regard to a central axis of the tube.

12. An impingement injector comprising:

an injector core including a plurality of conduits, the plurality of conduits including a first conduit and second conduits disposed circumferentially around the first conduit, the second conduits being at an impinging angle with respect to the first conduit; and a plurality of replaceable, tunable jets disposed in corresponding ones of the second conduits, wherein the plurality of replaceable, tunable jets are tubes and wherein at least a portion of the tubes threadingly engage the injector core.

13. The impingement injector as recited in claim 12, wherein the tubes each include an open end lying in a plane that is inclined with regard to a central axis of the tube.

14. An impingement injector comprising:

an injector core including a plurality of conduits, the plurality of conduits including a first conduit and second conduits disposed circumferentially around the first conduit, the second conduits being at an impinging angle with respect to the first conduit; and a plurality of replaceable, tunable jets disposed in corresponding ones of the second conduits, wherein the plurality of replaceable, tunable jets are tubes and wherein the tubes each include an open end lying in a plane that is inclined with regard to a central axis of the tube.

15. An impingement injector comprising:

an injector core including a plurality of conduits, the plurality of conduits including a first conduit and second conduits disposed circumferentially around the first conduit, the second conduits being at an impinging angle with respect to the first conduit; and a plurality of replaceable, tunable jets disposed in corresponding ones of the second conduits, wherein the plurality of replaceable, tunable jets are tubes and wherein the tubes include an internal surface having a faceted geometry.

16. The impingement injector as recited in claim 15, wherein the faceted geometry is a faceted, hexagonal geometry.

17. An impingement injector comprising:

an injector core including a plurality of conduits, the plurality of conduits including a first conduit and second conduits disposed circumferentially around the first conduit, the second conduits being at an impinging angle with respect to the first conduit; and a plurality of replaceable, tunable jets disposed in corresponding ones of the second conduits, wherein the injector core is a cylindrical plate.

18. The impingement injector as recited in claim 17, wherein the plurality of replaceable, tunable jets are tubes.

* * * * *